US005133510A

United States Patent [19]

Davis et al.

[11] Patent Number: 5,133,510

[45] Date of Patent: Jul. 28, 1992

[54] COLUMN WIRE WINDING APPARATUS

[75] Inventors: Edgar A. Davis; David T. Swanson, both of San Jose, Calif.

[73] Assignee: VSL Corporation, Campbell, Calif.

[21] Appl. No.: 523,119

[22] Filed: May 14, 1990

[51] Int. Cl.[5] ..... B65H 81/06

[52] U.S. Cl. ..... 242/7.210; 182/133

[58] Field of Search ..... 242/7.21, 7.22, 7.33; 52/653, 248; 182/133, 136, 187

[56] References Cited

U.S. PATENT DOCUMENTS

| | | | |
|---|---|---|---|
| 350,289 | 10/1886 | Brown | 182/136 |
| 2,520,402 | 8/1950 | Hirsh | 242/7.22 |
| 3,230,123 | 1/1966 | Christensen | 242/7.22 X |
| 3,237,720 | 3/1966 | Landovist | 182/133 |
| 3,380,675 | 4/1968 | Baxter et al. | 242/7.21 |
| 4,121,780 | 10/1978 | Taylor et al. | 242/7.21 |
| 4,677,936 | 7/1987 | Dahlem | 182/136 X |
| 4,786,341 | 11/1988 | Kobatake et al. | 52/653 X |

FOREIGN PATENT DOCUMENTS

| | | | |
|---|---|---|---|
| 386109 | 11/1971 | U.S.S.R. | 242/7.21 |
| 462921 | 6/1972 | U.S.S.R. | 242/7.21 |

*Primary Examiner*—Katherine Matecki

*Attorney, Agent, or Firm*—Fliesler, Dubb, Meyer & Lovejoy

[57] ABSTRACT

A column such as a concrete bridge or overpass column is reinforced by transverse post tensioning a steel wire around the length of the column. Apparatus for winding the wire around the column includes a first support frame which is attached to the column and a second support frame which is movably positioned around the column. The second support frame is movably supported on the first support frame whereby the second support frame can move axially along the length of the column. The second support frame includes a fixed inner ring, and a rotatable outer ring engages the inner ring in a tongue-in-groove fashion. The outer ring supports a spool of wire and a tensioning spool, and a drive motor and pinion mounted to the fixed inner ring drives the outer ring gear and rotates the spool of wire around the column as the second support frame is translated axially along a length of the column. The first support frame is repeatedly moved along the column until the full length of the column has been wound with wire.

11 Claims, 3 Drawing Sheets

COLUMN WIRE WINDING APPARATUS

BACKGROUND OF THE INVENTION

This invention relates generally to apparatus for reinforcing vertical columns such as supports in bridges and over passes, and more particularly the invention relates to apparatus for applying a reinforcing coil of wire around a column.

Concrete columns typically can support large compressive forces but are less resistant to torsion and bending forces which can be imparted thereto during an earthquake, for example. Cracks in the columns resulting from an earthquake can allow concrete particles to dislodge from the column.

Prior to the 1971 San Fernando earthquake in California spiral reinforcing of the vertical steel bars in reinforced concrete columns was not required or used. During the 1971 earthquake many columns failed due to the vertical bars breaking loose from the concrete columns, especially around joints.

Since 1971 spiral reinforcing has been required for the vertical bars prior to the pouring of concrete.

The present invention is directed to apparatus for reinforcing columns, especially pre-1971 columns, to provide containment of the vertical steel bars and prevent loss of concrete.

SUMMARY OF THE INVENTION

An object of the present invention is apparatus for reinforcing support columns and like support structures.

Another object of the invention is apparatus for winding a support wire around a column in situ for spiral reinforcement of the column.

Still another object of the invention is wire winding apparatus in which the pitch of the wire turns is readily altered.

Another object of the invention is a method for reinforcing support columns by transverse post tensioning.

Briefly, apparatus in accordance with the invention for reinforcing a column includes a first support frame including means for attaching the support frame around the column. A second support frame is movably positioned around the column, and first means is provided for movably supporting the second support frame on the first support frame. A rotatable support means is mounted to the second support frame and is rotatable thereon. A spool of wire is mounted on the rotatable support means for winding a coil of wire around the column as the rotatable support means is rotated on the second support frame. First drive means is provided for moving the second support frame relative to the first support frame axially along the column, and second drive means is provided for rotating the rotatable support means and the spool of wire around the second support frame.

In a preferred embodiment the second support frame comprises a fixed inner ring and the rotatable support means comprises a rotating outer ring. The outer ring comprises a ring gear, and the second drive means includes a first motor mounted to the fixed inner ring with a pinion for engaging and driving the ring gear.

The first means for movably supporting the second support frame preferably includes a plurality of ball screws supported by the first support frame and engaging the second support frame. The first drive means preferably comprises a second motor and a chain for engaging sprockets on the ball screws. Advantageously, the pitch of a turn of wire around the column can be established by the speeds of rotation of the first motor and the second motor.

In a preferred embodiment a tensioning spool is mounted on the rotatable support means with the wire from the wire spool passing around the tensioning spool as the wire is wound on the column. The wire can be prestressed as it is wound to provide transverse post tensioning and containment of the vertical steel bars during an earthquake.

The invention and objects and features thereof will be more readily apparent from the following detailed description and appended claims when taken with the drawing.

DETAILED DESCRIPTION OF ILLUSTRATIVE EMBODIMENTS

Figure 1:
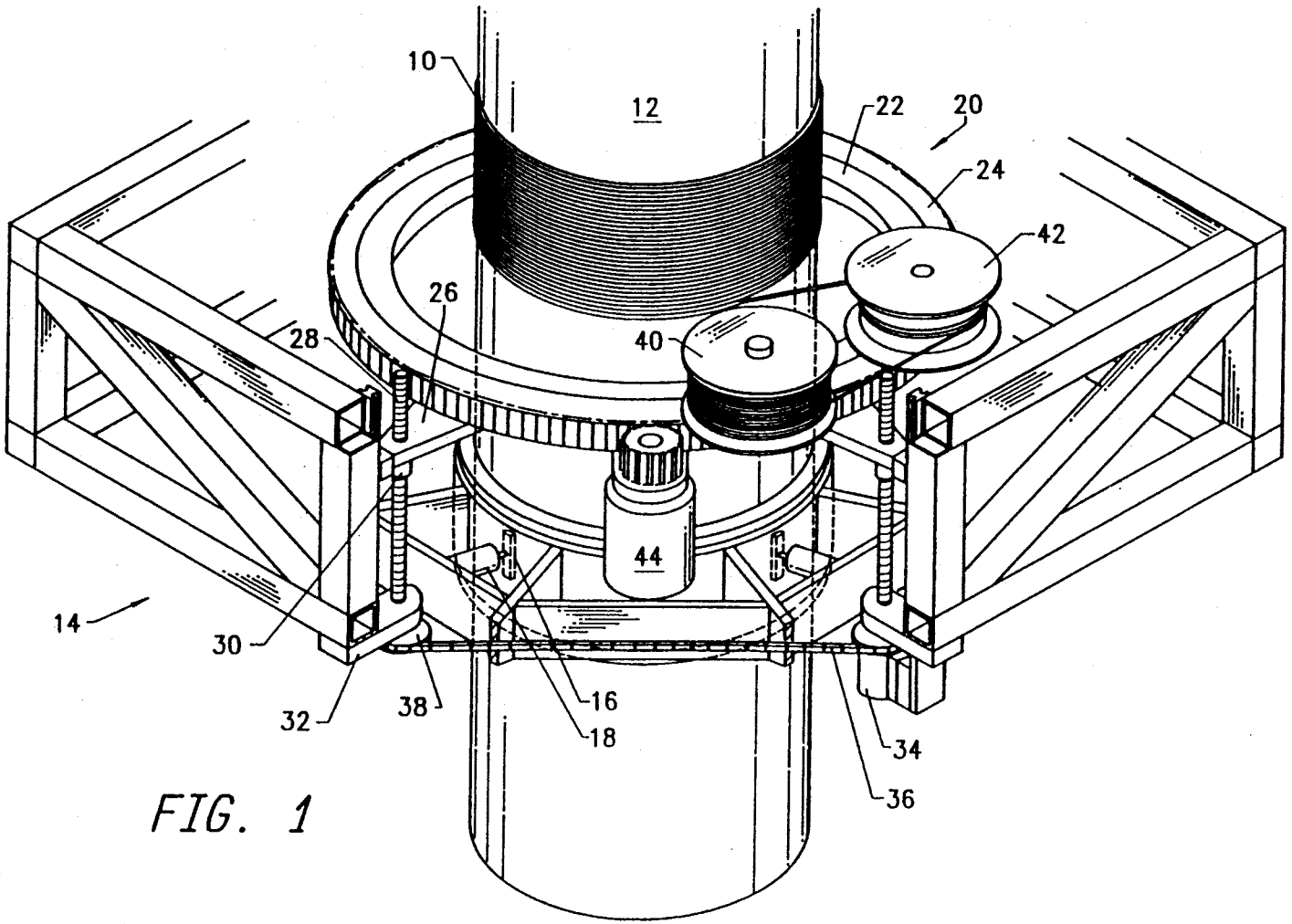
FIG. 1 is a perspective view of wire winding apparatus in accordance with a preferred embodiment of the invention.
Figure 2:
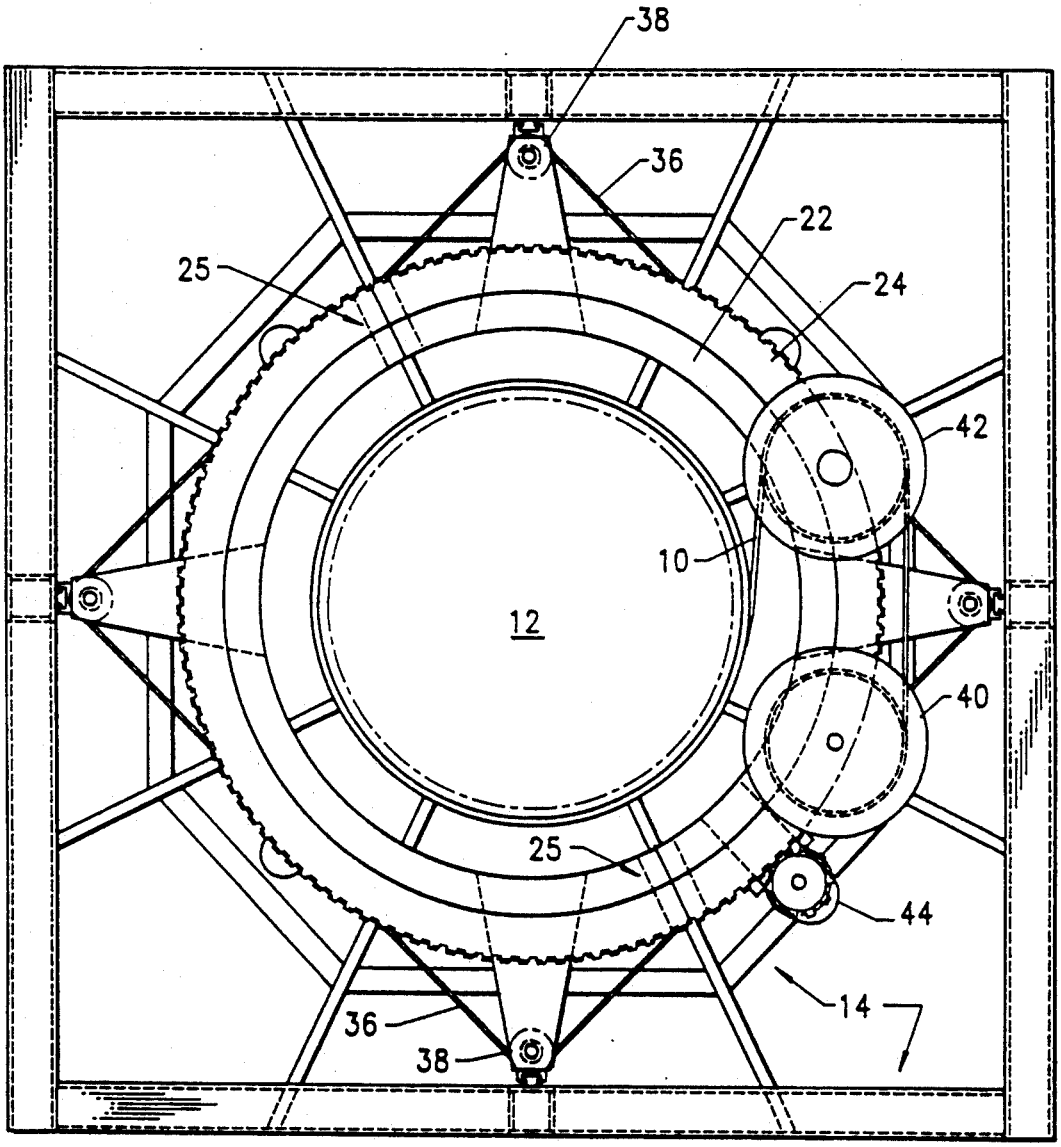
FIG. 2 is a top plan view of the apparatus of FIG. 1.
Figure 3:
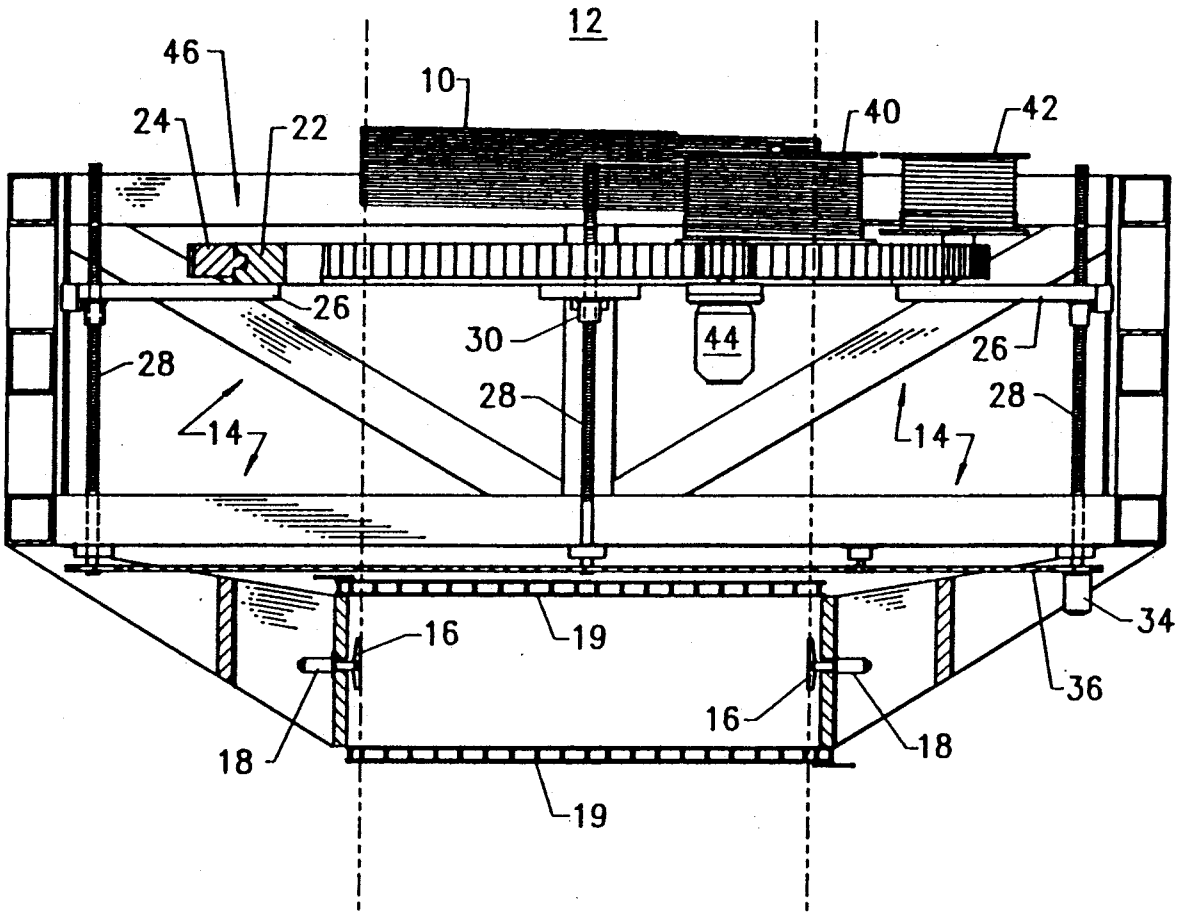
FIG. 3 is a side elevation of the apparatus of FIG. 1.

Referring now to the drawing, FIG. 1 is a perspective view of one embodiment of the invention, and FIGS. 2 and 3 are a top plan view and a side elevation of the apparatus, respectively.

As shown in FIG. 1, a wire 10 is tightly wound around a column 12 for reinforcement of the column by transverse post tensioning. The apparatus includes a stationary steel frame shown generally at 14 which includes a plurality of steel box frame elements which are fastened together by bolts, for example, to facilitate assembly and disassembly from around the column 12. Holding pads 16 mounted to hydraulic cylinders 18 engage column 12 and support the frame 14 thereon. As shown in FIG. 3, holding chains 19 are also employed to latch frame 14 to the column 12.

A second support frame shown generally at 20 comprises an assembly including a fixed inner ring 22 and an outer ring 24 which rotates on the fixed inner ring 22. The inner and outer rings are segmented as shown at 25 with the segments bolted together for ready assembly and disassembly from the column 12. Support tongues 26 extend from the inner ring and are engaged by ball screws 28 which support the tongues 26 on ball screw nuts 30. The ball screws 28 are supported by members 32 of the frame 14 whereby frame 14 supports frame 20. An elevation drive motor 34 is mounted to frame 14 and a chain 36 driven by motor 34 engages sprockets 38 at one end of the ball screws 28. The second support frame 20 is translated axially along the column 12 as the ball screws 28 are rotated by the drive motor 34 and chain 36.

Mounted on the rotatable outer ring 24 is a wire feeding spool 40 and a tensioning spool 42. The tensioning spool provides drag and tension in the wire as it is wound on the column 12. Accordingly, the steel wire can be stressed up to 70% or 255 psi. The outer rotating ring 24 is a ring gear which is driven by a drive motor and pinion 44. The wire 10 is wound on the column 12 as the drive and pinion 44 rotate the ring gear 24. As shown partially in section view at 46 in FIG. 3, the outer ring gear 24 and the fixed inner ring 22 engage in tongue-in-groove whereby the inner ring supports the outer ring.

In operation, the stationary steel frame 14 is first assembled around a column and attached thereto by means of the holding pads 16 and holding chains 19. The inner and outer rings are then assembled around the column with the ball screws supporting the rings on the stationary frame 14. The wire 10 is fastened to the column 12 and the spool 14 is then rotated around the column as the moving assembly 20 is lowered on the frame 14. Once the moving assembly 20 has traveled the full length permitted by the ball screws 28, the fixed frame is moved downwardly on the column 12 while the moving assembly 20 is raised to its upper most position relative to the frame 14. The spool 40 is then rotated around the column 12 for another length of travel. The frame 14 is repeatedly moved on the column 12 until the desired length of the column is wound by the wire. Reinforcement can be for the full length of the column or can be limited to areas around joints in the column where vertical steel bars end.

After the desired length of the column has been wound by the wire, the apparatus is removed, and the wire can be coated with a corrosion resistant material.

The reinforcement of vertical concrete columns using the apparatus and method of the invention will prolong the life of the column and its supported load by providing transverse post tensioning and containment of the vertical steel bars especially in columns built prior to 1971.

While the invention has been described with reference to a specific embodiment, the description is illustrative of the invention and is not to be construed as limiting the invention. The apparatus can be used with other support structures such as brick and masonry walls. Various other modifications and applications may occur to those skilled in the art without departing from the true spirit and scope of the invention as defined by the appended claims.

We claim:

1. Apparatus for reinforcing a column and like support structures comprising a first support frame including a plurality of holding pads and hydraulic means for forcibly engaging said holding pads on said column, a second support frame movably positioned around the column, first means for movably supporting said second support frame on said first support frame, a rotatable support member mounted to said second support frame and rotatable thereon, a spool of wire mounted on said rotatable support member, first drive means for moving said second support frame relative to said first support frame, and second drive means for rotating said rotatable support member and said spool of wire around said second support frame.

2. Apparatus as defined by claim 1 and further including a tensioning spool mounted on said rotatable support member, said wire from said spool passing around said tensioning spool as said wire is wound on the column.

3. Apparatus as defined by claim 1 wherein said second support frame comprises a fixed inner ring and said rotatable support member comprises a rotating outer ring.

4. Apparatus as defined by claim 3 wherein said rotating outer ring comprises a ring gear, and said second drive means includes a first motor mounted to said fixed inner ring and a pinion for engaging and driving said ring gear.

5. Apparatus as defined by claim 4 wherein said first drive means for movably supporting said second support frame includes a plurality of ball screws supported by said first support frame and engaging said second support frame.

6. Apparatus as defined by claim 5 wherein each of said plurality of ball screws includes a sprocket, and said first drive means comprises a second motor and a chain for engaging and driving said sprockets.

7. Apparatus as defined by claim 6 wherein the pitch of a turn of wire around the column is determined by the speed of said first motor and the speed of said second motor.

8. Apparatus as defined by claim 3 wherein said fixed inner ring and said rotatable outer ring engage in a tongue-in-groove arrangement.

9. Apparatus as defined by claim 1 wherein said first drive means for moving said second support frame includes a plurality of ball screws supported by said first support frame and engaging said second support frame.

10. Apparatus as defined by claim 9 wherein each of said plurality of said ball screws includes a sprocket, and said first drive means comprises a motor and a chain for engaging and driving said sprockets.

11. Apparatus as defined by claim 1 wherein said means for attaching said first support frame to said column includes at least one holding chain which engages said first support frame and said column.

* * * * *